US007431183B2

(12) United States Patent
Keough et al.

(10) Patent No.: US 7,431,183 B2
(45) Date of Patent: Oct. 7, 2008

(54) COVER ASSEMBLY FOR A PAINT CAN HAVING AN IMPROVED SEAL

(75) Inventors: James A. Keough, Howell, MI (US); Alain Krzywdziak, Orleans (FR)

(73) Assignee: Dedoes Industries, Inc., Walled Lake, MI (US)

( * ) Notice: Subject to any disclaimer, the term of this patent is extended or adjusted under 35 U.S.C. 154(b) by 629 days.

(21) Appl. No.: 10/910,133

(22) Filed: Aug. 3, 2004

(65) Prior Publication Data

US 2006/0027580 A1 Feb. 9, 2006

(51) Int. Cl.
*B65D 51/18* (2006.01)
*B65D 25/40* (2006.01)

(52) U.S. Cl. ..... 222/570; 220/256.1

(58) Field of Classification Search ..... 222/567, 222/569, 570, 574; 220/256.1, 285
See application file for complete search history.

(56) References Cited

U.S. PATENT DOCUMENTS 4,579,257 A * 4/1986 Brandlein ..... 222/192
5,176,278 A * 1/1993 Quarberg ..... 220/320
5,622,289 A * 4/1997 Dedoes ..... 222/472
5,720,408 A * 2/1998 Schmid et al. ..... 220/287
5,800,057 A 9/1998 Lesimple ..... 366/198
6,126,048 A * 10/2000 Bublitz ..... 222/570
6,352,185 B1 * 3/2002 Arabnia ..... 222/473

FOREIGN PATENT DOCUMENTS

CN 01249862.9 6/2001

* cited by examiner

*Primary Examiner*—Kevin P. Shaver
*Assistant Examiner*—Melvin A Cartagena
(74) *Attorney, Agent, or Firm*—Gifford, Krass, Sprinkle, Anderson & Citkowski, P.C.

(57) ABSTRACT

A cover assembly for a paint can having an annular sidewall and an annular chime extending radially inwardly from the sidewall adjacent an open end of the can. The cover assembly includes a lid dimensioned to overlie the open end of the can. A conical resilient seal is attached to an underside of the lid. The seal is dimensioned so that, with the lid positioned over the open end of the can and locked to the can, the seal engages an inner annular edge of the chime. A snap-in locking ring detachably secures the seal to the lid.

10 Claims, 4 Drawing Sheets

COVER ASSEMBLY FOR A PAINT CAN HAVING AN IMPROVED SEAL

BACKGROUND OF THE INVENTION

I. Field of the Invention

The present invention relates generally to cover assemblies for paint cans and, more particularly, to a cover assembly with improved means for sealing the cover assembly to the paint can.

II. Description of Related Art

There are a number of previously known cover assemblies for paint cans which are dimensioned to overlie the open top of the paint can. Such cover assemblies include a spout and a cooperating closure which selectively opens and closes the spout. When the spout is open, paint can be dispensed from the can. Otherwise, the closure protects the contents of the paint can from external debris and also minimizes evaporation of the paint.

Many of these previously known cover assemblies are designed for use with automatic paint stirring equipment. As such, they include a stirring assembly rotatably mounted to the cover assembly such that the stirrer is positioned within the can once the cover assembly is mounted onto the can. A drive member extends upwardly from the paint cover assembly and cooperates with the drive member in a rack of the automatic paint stirring equipment in order to continuously stir the paint. Such automatic paint stirring equipment is typically used in automotive body repair shops and the like.

Alternatively, a manually operated arm may be attached to the drive member where the cover assembly is used for paint cans with manual stirring, rather than automatic paint stirring equipment.

In order to seal the cover assembly to the paint can, the previously known cover assemblies have typically used a flat annular seal ring which is attached to the underside of the lid of the cover assembly. Consequently, with the lid positioned over the open end of the paint can, the seal is sandwiched in between the outer annular edge of the paint can at its open end and the lid. These previously known seals, however, have not proven wholly satisfactory in use.

One disadvantage of these previously known seals is that the dimension of paint cans have not been standardized. As such, the actual diameter of the paint cans, as well as the radially inwardly protruding chime at the open end of the paint can, vary in dimension in both height and diameter from one manufacturer to the next. Consequently, although one seal may prove adequate to seal the lid to the paint can for one can manufacturer, an inadequate seal between the lid and the paint can is obtained when the cover assembly with that seal is used with a paint can from a different manufacturer.

A still further disadvantage of these previously known cover assemblies for paint cans is that a portion of the paint is entrapped between the seal and the chime as the paint is poured or dispensed from the paint can. This entrapped portion cannot be easily extracted from the paint can. Furthermore, in view of the high cost of certain automotive paints, even the loss of relatively small amounts of the automotive paint constitutes a significant cost.

SUMMARY OF THE PRESENT INVENTION

The present invention provides a cover assembly for a paint can which overcomes all of the above-mentioned disadvantages of the previously known devices.

In brief, the cover assembly of the present invention comprises a lid dimensioned to overlie the open top of the paint can. Although any conventional means may be used to detachably secure the lid to the paint can, preferably a plurality of circumferentially spaced resilient tabs formed on the paint can engage the outer rim of the paint can around its open end.

A conical resilient seal is attached to an underside of the lid. The seal is dimensioned so that, with the seal positioned over the open end of the paint can, the seal engages an inner annular edge of the chime of the paint can.

Since the conical seal flares outwardly from its lower end and towards the lid, the conical resilient seal achieves a tight seal between the cover assembly and the paint can despite variances in the size or inside diameter of the chime or the height of the chime relative to the paint can.

Although any conventional means may be used to secure the seal to the lid, preferably an annular lock ring is detachably secured to the lid. In its attached position, the lock ring sandwiches an inner peripheral portion of the seal between the lock ring and the lid.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
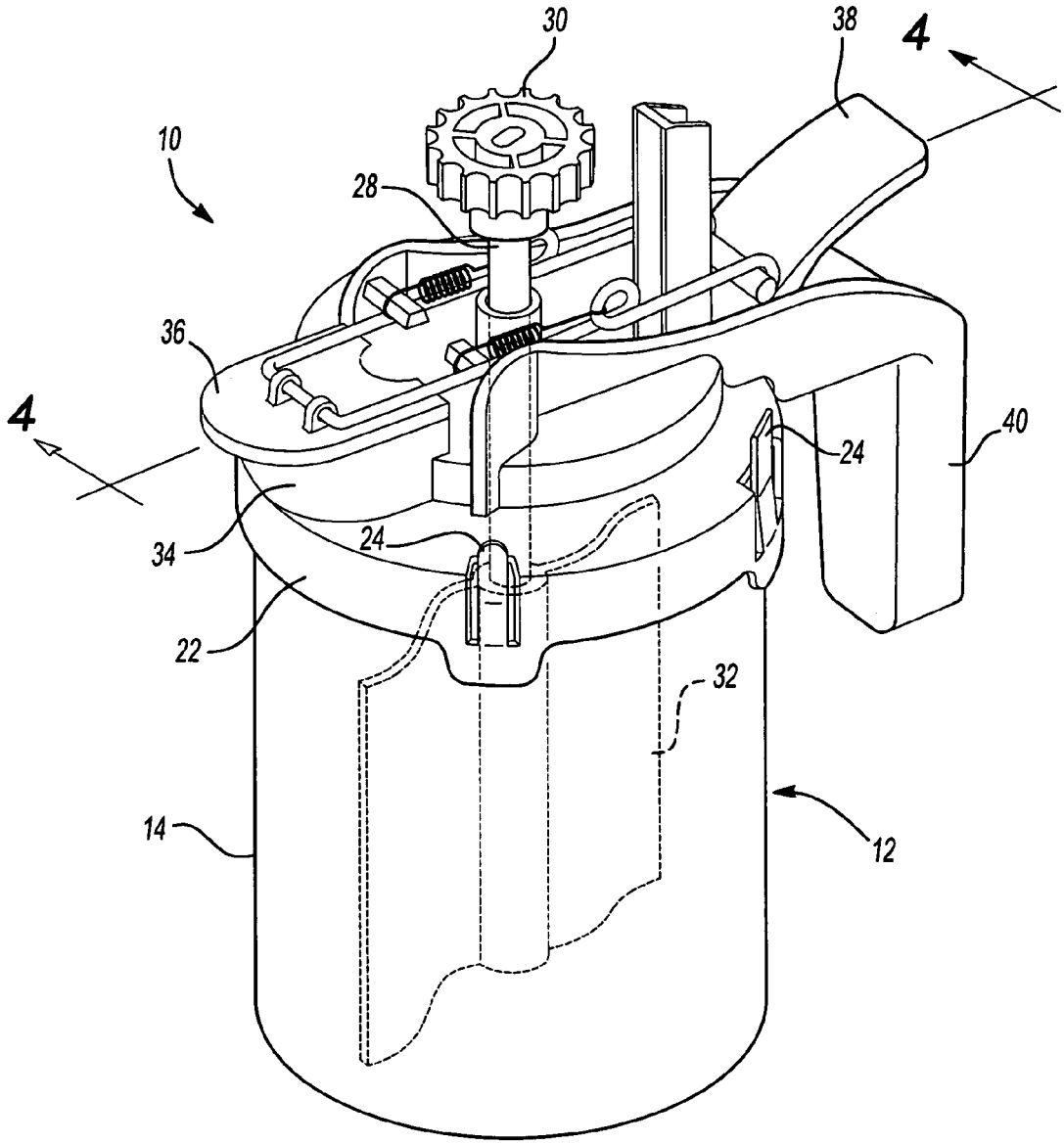
FIG. 1 is a perspective view illustrating a preferred embodiment of the cover assembly of the present invention.
Figure 4:
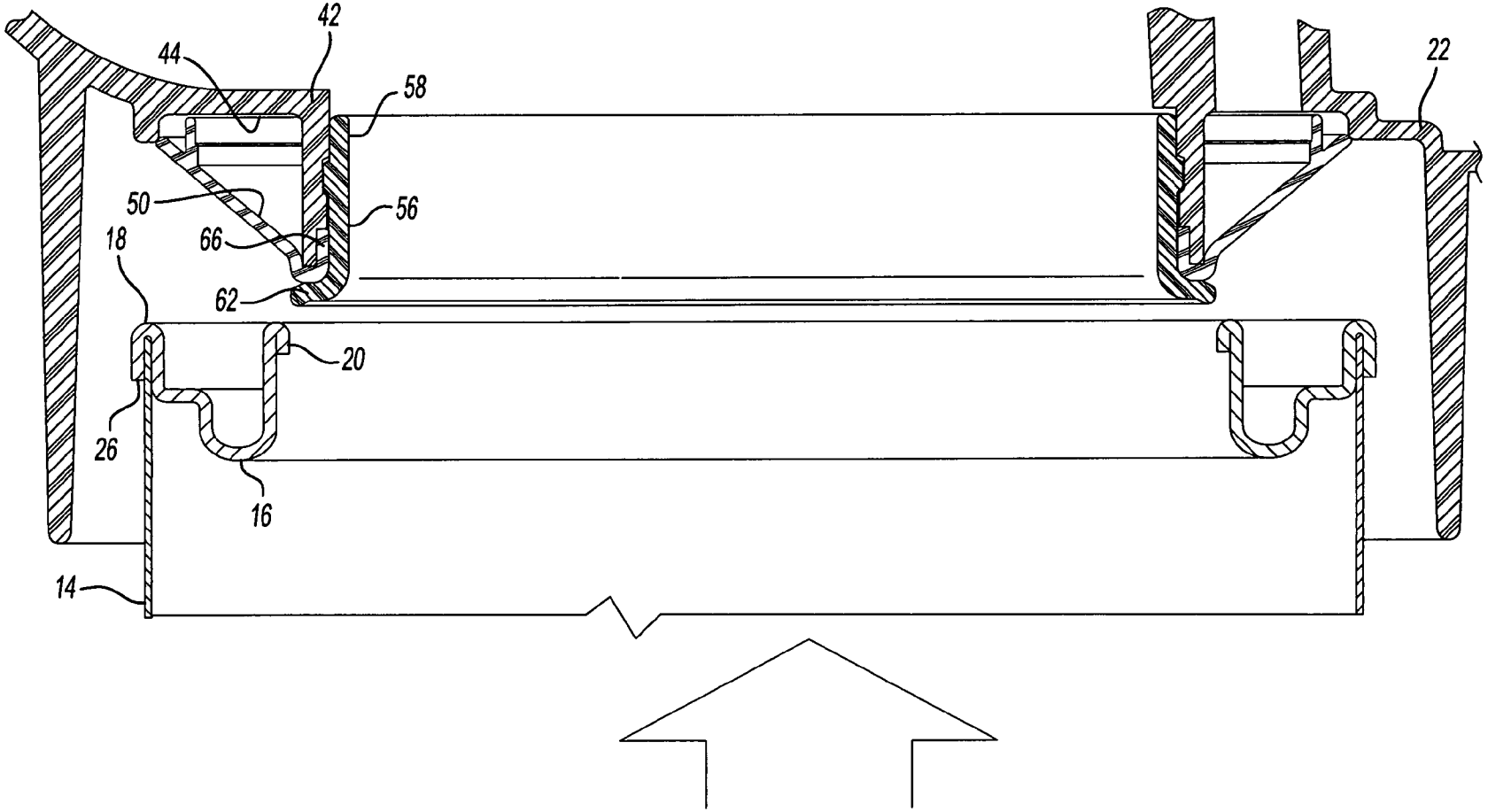
FIG. 4 is a sectional view taken substantially along line 4-4 in FIG. 1 and enlarged for clarity.

With reference first to FIGS. 1 and 4, a preferred embodiment of the cover assembly 10 of the present invention is shown for use with a paint can 12. The paint can 12 includes a tubular and cylindrical sidewall 14. An annular chime 16 (FIG. 4) protrudes radially inwardly from an upper open end 18 of the paint can sidewall 14. This chime 16 defines a circular opening 20 to provide access to the contents of the can 12.

The cover assembly 10 includes a lid 22 dimensioned to overlie the open top 18 of the paint can 12. Although any conventional means may be used to detachably secure the lid 22 across the open top 18 of the paint can 12, as illustrated in FIG. 1, a plurality of circumferentially spaced resilient and radially deflectable locking tabs 24 are formed around the outer periphery of the lid 22. These locking tabs 24 lockingly engage an outer rim abutment surface 26 (FIG. 4) once the lid 22 is positioned over the paint can 12 and depressed downwardly across the open top 18 of the paint can 12.

The cover assembly 10 illustrated in FIG. 1 is shown for use with automatic paint stirring equipment. As such, it includes a stirring shaft 28 rotatably mounted to the lid 22 and having a drive member 30 attached to the portion of the shaft 28 which protrudes upwardly from the top of the lid 22. A stirrer 32 is attached to the opposite end of the shaft 28 so that the stirrer 32 is positioned within the interior of the can 12 once the lid 22 is positioned over the open top 18 of the can 12.

Alternatively, a manually operated stirrer arm (not shown) may be substituted for the drive member 30 where the cover assembly 10 is used for paint cans 12 in which the paint will be manually stirred.

The cover assembly 10 also includes a dispensing spout 34 mounted on the lid 22. A closure 36 is slidably mounted to the lid 22 and operated by a lever 38 to selectively open and close the spout 34. A handle 40 also protrudes outwardly from the side of the lid 22 opposite from the spout 34 to facilitate manual manipulation of the cover assembly 10 with its attached can 12.

Figure 2:
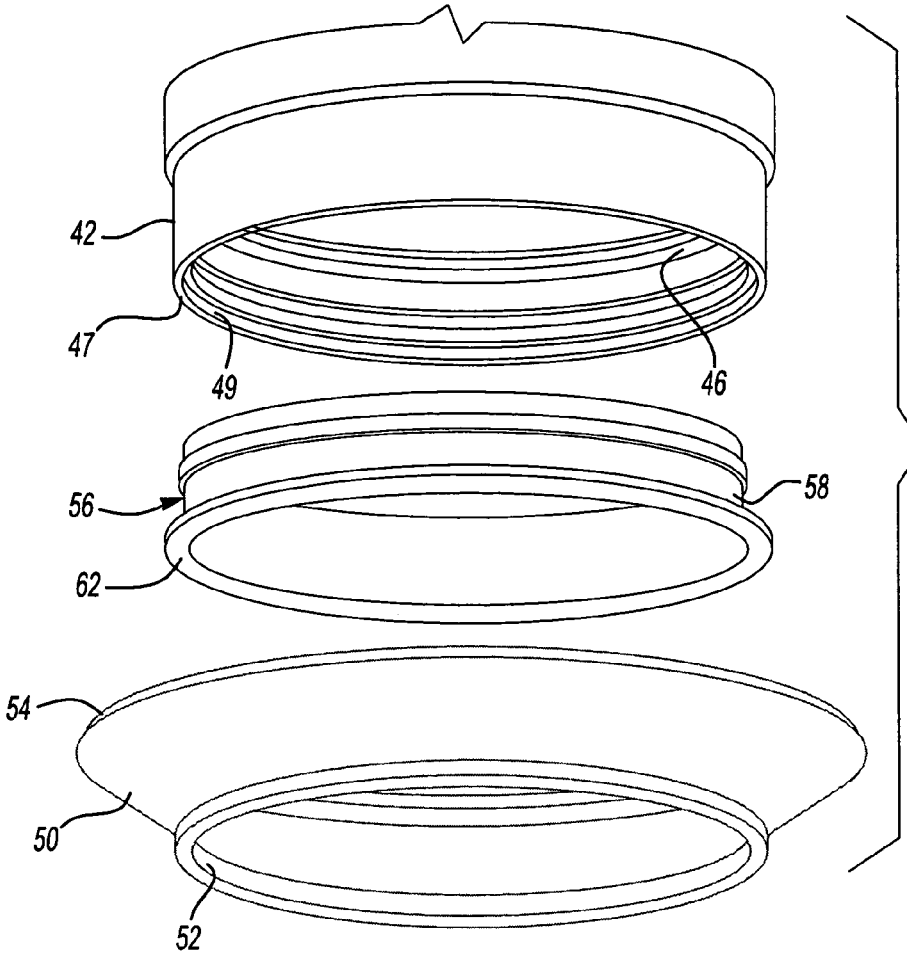
FIG. 2 is an exploded view illustrating the preferred embodiment of the invention.
Figure 3:
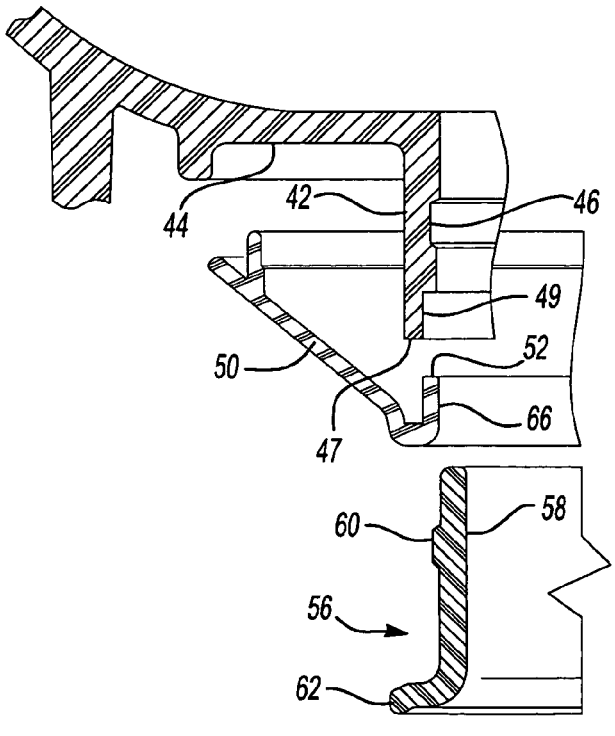
FIG. 3 is a fragmentary sectional exploded view of the preferred embodiment of the invention.

With reference now to FIGS. 2-4, an annular tubular hub 42 having an outside diameter smaller than the can opening 20 protrudes coaxially outwardly from an underside 44 of the lid 22. This hub 42 includes a first annular groove 46 formed around its inner surface at a position axially spaced from its lower end 47. A second annular groove 49 is formed at the lower end 47 of the hub.

Still referring to FIGS. 2-4, the cover assembly 10 further includes a conical annular seal 50 having an inner edge 52 and an outwardly flared outer edge 54. The seal 50 is positioned over the hub 42 so that its inner edge 52 overlies the notch 49 formed around the inner surface of the lid hub 42. In doing so, the seal 50 flares upwardly and outwardly from the bottom 47 of the hub 42.

An annular lock ring 56 is provided to detachably secure the seal 50 to the lid 22. The lock ring 56 includes a tubular portion 58 having an outwardly protruding annular shoulder 60 from its upper end. Additionally, a lip 62 extends outwardly from the lower end of the lock ring 56.

In order to secure the seal 50 to the lid 22, the seal 50 is first positioned over the lower portion of the lid hub 42. The lock ring 56 is then compressed into the hub 42 until the shoulder 60 on the lock ring 56 registers with the hub groove 46. Simultaneously, an inner edge portion 66 of the seal 50 is compressibly sandwiched in between the lock ring 56 and the hub 42 thus detachably securing the seal 50 to the hub 42. Preferably, the seal 50 is dimensioned so that the inner edge portion 66 nests within the hub notch 49. Consequently, the inner edge portion 52 of the seal 50 is subjected both to radial compression between the lock ring 56 and the hub 42, as well as axial compression between the lock ring flanges 62 and the lower end of the hub 42 thus ensuring a complete seal.

Figure 5:
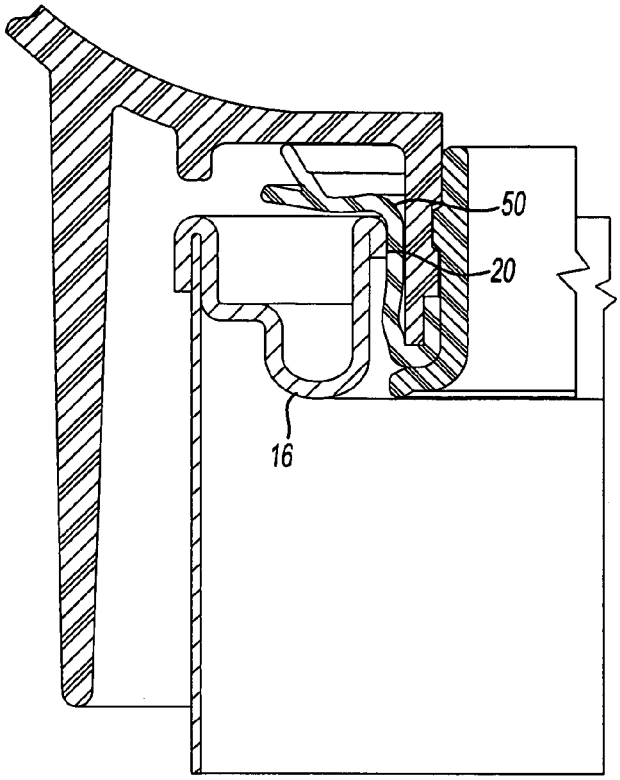
FIGS. 5 and 6 are fragmentary sectional views illustrating the preferred embodiment of the invention used with chimes of different sizes.
Figure 6:
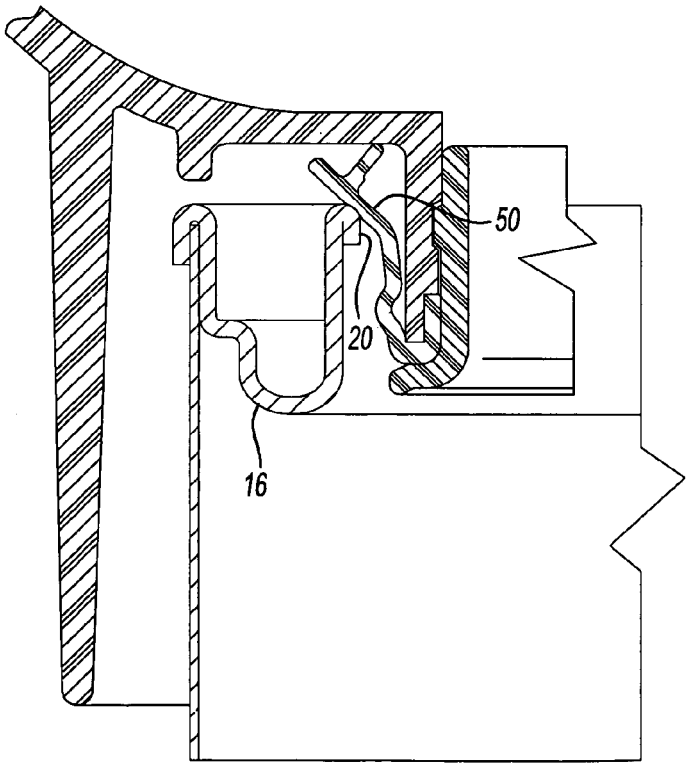

With reference now to FIG. 5, the operation of the present invention will be described. As the lid 22 is moved from its detached position and to its attached position, the seal 50 sealingly engages the innermost edge 20 of the chime 16 thus sealing the lid 22 to the paint can 12. Furthermore, as shown in FIG. 6, the conical shape of the seal 50 enables the seal 50 to sealingly engage the inner edge 20 of the chime 16, even for chime 16 having variations in both height relative to the can, as well as different diameters.

From the foregoing, it can be seen that the present invention provides a cover assembly for a paint can having an improved seal which enables the lid 22 to be used with paint cans having chimes of different sizes and different heights. Furthermore, the snap fit engagement between the lock ring 56 and the lid 22 enables the seal 50 to be easily and quickly assembled onto the cover assembly 10 and, if necessary, replaced in the field.

Having described my invention, however, many modifications thereto will become apparent to those skilled in the art to which it pertains without deviation from the spirit of the invention as defined by the scope of the appended claims.

We claim:

1. A cover assembly for a paint can having an annular sidewall and an annular chime extending radially inwardly from the sidewall adjacent an open end of the can, said cover assembly comprising:

a lid dimensioned to overlie the open end of the can, an annular conical resilient seal attached to an underside of said lid, said seal flaring upwardly and outwardly from a bottom portion of said lid, said seal dimensioned so that, with said lid positioned over the open end of the can, a radially outwardly facing surface of said seal engages an inner annular edge of the chime, a lock ring movable between a locked position and a detached position, wherein in said locked position said lock ring sandwiches a portion of said seal between said lock ring and said lid to thereby attach said seal to said lid.

2. The invention as defined in claim 1 wherein said lid includes an annular groove and said lock ring includes an annular shoulder, said shoulder nesting in said groove when said lock ring is in said locked position to thereby attach said lock ring to said lid.

3. The invention as defined in claim 2 wherein said lock ring is made of a resilient material.

4. The invention as defined in claim 3 wherein said lock ring is made of plastic.

5. The invention as defined in claim 2 wherein said lid includes an annular boss protruding outwardly from the underside of the lid, said groove being formed around an inner surface of said boss.

6. The invention as defined in claim 1 wherein said seal includes a central throughbore.

7. The invention as defined in claim 6 wherein said lock ring includes a central tubular portion which extends through said seal bore, said tubular portion of said ring being detachably secured to said lid when said lock ring is in said locked position.

8. The invention as defined in claim 1 wherein said lid further comprises a spout and a closure which selectively opens and closes said spout.

9. The invention as defined in claim 1 and further comprising means for detachably securing said lid to the can.

10. The invention as defined in claim 9 wherein said detachable securing means comprises a plurality of circumferentially spaced resilient locking tabs which engage an outer rim on the chime when said lid is placed onto the open top of the can.

* * * * *